US009010068B2

(12) United States Patent
Sullivan et al.

(10) Patent No.: US 9,010,068 B2
(45) Date of Patent: Apr. 21, 2015

(54) TILE KIT AND METHOD

(71) Applicant: MATCLAD Limited, Flintshire (GB)

(72) Inventors: Paul Neil Sullivan, Cheshire (GB); Neil Anthony Sullivan, Cheshire (GB)

(73) Assignee: MATCLAD Limited, Ewloe, Flintshire (GB)

( * ) Notice: Subject to any disclaimer, the term of this patent is extended or adjusted under 35 U.S.C. 154(b) by 0 days.

(21) Appl. No.: 13/894,340

(22) Filed: May 14, 2013

(65) Prior Publication Data

US 2013/0298497 A1 Nov. 14, 2013

(30) Foreign Application Priority Data

May 14, 2012 (GB) ..... 1208375.4

(51) Int. Cl.
*E04F 21/22* (2006.01)
*E04F 13/08* (2006.01)
*E04F 13/14* (2006.01)

(52) U.S. Cl.
CPC ..... *E04F 13/08* (2013.01); *E04F 13/0801* (2013.01); *E04F 13/0862* (2013.01); *E04F 13/147* (2013.01)

(58) Field of Classification Search
CPC ..... E04F 13/00; E04F 13/0864; E04F 13/147; E04F 19/022; E04F 13/08; E04F 13/14; E04F 15/02; E04F 13/0801; E04F 13/0841
USPC ..... 52/747.11, 591.5, 582.1, 582.2, 589.1, 52/390–391, 749.11, 384–387, 393, 395, 52/396.04, 396.05, 396.07, 396.08, 52/396.09, 396.1, 506.01, 506.05, 461, 52/235, 596–597, 603, 286; 404/47
See application file for complete search history.

(56) References Cited

U.S. PATENT DOCUMENTS

| | | | | |
|---|---|---|---|---|
| 1,704,035 | A * | 3/1929 | Cochran | 52/387 |
| 1,787,480 | A * | 1/1931 | Jaspert | 404/40 |
| 2,148,858 | A * | 2/1939 | Freeman et al. | 52/506.01 |
| 2,183,450 | A * | 12/1939 | Filangeri | 52/286 |
| 2,191,267 | A * | 2/1940 | Willson | 52/387 |
| 5,016,413 | A * | 5/1991 | Counihan | 52/391 |
| 5,335,473 | A * | 8/1994 | Chase | 52/745.08 |
| 5,359,954 | A * | 11/1994 | Kordelin | 114/85 |
| 5,501,049 | A * | 3/1996 | Francis et al. | 52/387 |
| 6,079,177 | A * | 6/2000 | Halchuck | 52/506.06 |
| 6,098,363 | A * | 8/2000 | Yaguchi | 52/385 |
| 6,363,675 | B1 * | 4/2002 | Shelton | 52/403.1 |
| 6,470,641 | B1 * | 10/2002 | Faure | 52/480 |
| 6,516,578 | B1 * | 2/2003 | Hunsaker | 52/387 |
| 6,951,086 | B2 * | 10/2005 | Passeno | 52/386 |
| 6,990,778 | B2 * | 1/2006 | Passeno | 52/385 |
| 7,121,052 | B2 * | 10/2006 | Niese et al. | 52/403.1 |
| 7,409,803 | B2 * | 8/2008 | Grohman | 52/489.1 |
| 7,578,105 | B2 * | 8/2009 | Eberle, III | 52/403.1 |
| 7,805,902 | B2 * | 10/2010 | Martel | 52/489.1 |
| 2002/0124504 | A1 * | 9/2002 | Maylon et al. | 52/318 |
| 2005/0257475 | A1 * | 11/2005 | Gong et al. | 52/506.05 |
| 2011/0138728 | A1 * | 6/2011 | Kuznetsov | 52/578 |

* cited by examiner

*Primary Examiner* — Beth Stephan
(74) *Attorney, Agent, or Firm* — Hoffman Warnick LLC

(57) ABSTRACT

A kit for fixing tiles to a wall comprising: a tile having a protrusion extending from an edge thereof; and a fixing element arranged to be fastened to the wall and to accommodate the protrusion so as to secure the tile in position.

14 Claims, 15 Drawing Sheets

TILE KIT AND METHOD

CROSS-REFERENCE TO RELATED APPLICATIONS

This application claims the benefit of British Patent Application No. 1208375.4 filed 14 May 2012, which is hereby incorporated herein.

BACKGROUND

The present invention relates to tiles, especially brick tiles and to a method and kit for arranging and fixing the same.

In recent years, the importance of reducing household energy consumption has been recognised by homeowners, the construction industry and governments due to the rising cost of energy and concerns about climate change. An effective approach to reducing household energy consumption is to reduce heat loss from the building and so reduce the amount of energy required to heat the building to a comfortable temperature. Heat loss from buildings can be reduced by improving the insulating capability of the walls. The walls of many houses, for example those built in the UK since the 1920's include an air space or cavity between an outer and an inner brick or masonry wall. This air space or cavity can be filled during or after construction of the building with an insulating material. Suitable insulating materials include polyurethane, glass wool, polystyrene and natural insulating materials, for example cellulose materials and sheep's wool.

However, a significant proportion of houses, including much of current UK housing, were constructed with solid walls and therefore do not have a cavity which can be filled with insulating material. To insulate buildings constructed with solid walls, a layer of insulating material can be added to either the outside-facing surface or the inside-facing surface of the wall. If the insulating material is applied to the inside-facing surface of the wall, the size of the rooms inside the building is necessarily reduced and significant redecoration of the rooms is required. If the insulating material is added to the outside surface of the walls, the appearance of the building may be altered significantly. Once the insulating material is added to the outside surface of the walls a further layer of building material may be applied to provide the necessary weatherproof and visually appealing finish to the walls. A finish that has the appearance of a conventional brick wall is often desirable in these circumstances.

A brick finish could of course be achieved by adding a further external layer of conventional bricks. However this is an expensive option as it consumes large amounts of materials and the bricks must be laid by a skilled labourer. In addition this further adds to the increased thickness of the house and takes up space from the street or garden, which is generally undesirable. One favoured method is therefore to provide a finish with the appearance of a conventional brick wall by fixing brick tiles to the walls. Brick tiles are typically made from the same material as a conventional brick but are much thinner, and may be cut from a full brick.

Thus when fixed to a wall brick tiles (also known as brick slips) give the appearance of a standard brick finish but are much thinner. Brick tiles may be fixed to the existing structure either with adhesive or with a mechanical fastening. However the use of adhesive is a relatively recent development and thus the long term success of adhesive has not been established in practice during the normal life of a building. To ensure safety in the event that the adhesive fails, building specifiers often require that a mechanical fixing method is used above a certain height. However, currently available mechanical fixing systems are often complex to manufacture and expensive. One such system of the prior art involves providing a steel support structure and brick tiles which are moulded to engage with the support. Although such mechanical fastening systems are effective they add cost and complexity.

SUMMARY OF THE INVENTION

It is an aim of the present invention to provide improved means for the fixing of brick tiles to a wall.

According to a first aspect of the present invention there is provided a kit for fixing tiles to a wall comprising: a tile having a protrusion extending from an edge thereof; and a fixing element arranged to be fastened to the wall and to accommodate the protrusion so as to secure the tile in position.

The invention may be used to fix any type of tile to a wall. However in preferred embodiments the tile is a brick tile. The tile may be made from any suitable material, for example clay, sand, cement, resin, plastic, wood, metal or other ingredients including those used in the manufacture of a conventional brick. The major dimensions of the tile are such that they have a length and width which substantially match the size of the side of a conventional brick when viewed from its longest side, that is the side that would normally be visible in a constructed building. Such brick tiles are also known in the art as brick slips. However tiles having different dimensions are also within the scope of the invention. The tiles may for example have the dimensions of large format, Roman or other non-standard bricks.

A brick tile may be regarded as having a length, a width and a depth or thickness. In such tiles the thickness of the tile is much shorter than the width or length. This helps reduce the increase in the thickness of the walls when the tiles are fixed to the wall.

The tiles are preferably substantially rectangular in shape, that is they have four right angles and two sets of parallel sides. The two sets of sides may be the same or of similar length and thus the tile may be substantially square in shape. However in preferred embodiments one set of parallel sides is longer than the other set of parallel sides and the tile has the shape of an elongate rectangle. In this specification "elongate rectangle" does not necessarily mean that the rectangle is long and thin. Rather this term is used to distinguish the shape from a square.

In some preferred embodiments the brick tile is elongate rectangular in shape. Preferably the length of the tile is at least 1.5 times the width. Suitably the ratio of the length to the width of the tile is at least 2:1, for example about 2.5:1 to about 3:1. The ratio of the length to the width may be up to 10:1. Thus in preferred embodiments the tile may be regarded as having two parallel longer edges, two parallel shorter edges and a thickness.

The tile has a protrusion which extends from an edge thereof. The protrusion suitably does not increase the thickness dimension of the tile.

The protrusion may extend across the thickness of the tile. Preferably the protrusion does not have a thickness greater than the thickness of the tile. Suitably the thickness of the protrusion is less than the thickness of the tile. Preferably one face of the protrusion is coplanar with one face of the tile. Preferably one face of the protrusion is coplanar with one face of the tile and the protrusion has a thickness less than the thickness of the tile. Thus the tile suitably has a protrusion extending from a longer edge thereof substantially in the plane of the tile but does not extend across the full thickness of the tile. The protrusion may be shaped as a step, that is if the tile is laid on a flat surface the lower surface of the main body of the tile and the lower surface of the protrusion would be in contact with the flat surface but the upper surface of the tile would be taller than the upper surface of the protrusion.

The fixing element is arranged to be fastened to the wall and to accommodate the protrusion so as to secure it in position.

The fixing element of the invention is a mechanical fixing means and does not involve the use of adhesive. However it may be used to further secure tiles which have been positioned on a wall using adhesive.

The fixing element may be fastened to the wall using any suitable means. Such means will be known to the person skilled in the art and include, for example screws, bolts, pins and the like.

The fixing element may include one or more apertures, hooks, loops or the like to assist with fastening to the wall.

The fixing element is suitably positioned over the protrusion in use and this suitably includes a portion which covers at least a portion of the protrusion.

In preferred embodiments the fixing element comprises an elongate strip. The strip may be substantially of the same dimension along its length or it may vary in dimension. Preferably it is of substantially the same dimension along its length.

Most preferably the fixing element comprising an elongate strip includes a plurality of apertures to facilitate fastening to the wall.

The protrusion may extend from any edge of the tile. In embodiments in which the tile is elongate rectangular the protrusion preferably extends from a longer edge.

Each tile may comprise more than one protrusion. In some embodiments each tile comprises at least two protrusions. Preferably the tile has protrusions extending from two edges. Preferably these edges are parallel, i.e. in preferred embodiments the tile has protrusions extending from two parallel edges. In some embodiments the tile has one protrusion extending from one edge and one protrusion extending from a parallel edge. In some embodiments the tile has two protrusions extending from one edge and two protrusions extending from a parallel edge.

In embodiments in which the tile has the shape of an elongate rectangle each protrusion extends from a longer edge of the tile. In preferred embodiments there is no protrusion on either of the shorter edges of the tile. In some embodiments a protrusion extends from each of the longer edges of the tile. In some preferred embodiments one protrusion extends from each longer edge of the tile. In some embodiments two protrusions extend from one longer edge of the tile. In some especially preferred embodiments two protrusions extend from each longer edge of the tile.

In preferred embodiments of the present invention the kit of the first aspect comprises a plurality of tiles, preferably brick tiles. These tiles are suitably adapted to be able to cooperate with each other to form a regular pattern on a wall.

Preferably the kit comprises a plurality of tiles of similar size and shape. Preferably the kit comprises a plurality of tiles of substantially identical dimensions. However the skilled person will appreciate that due to the nature of these materials, exact identity of the individual tiles is unlikely to be achieved. In any case minor variations can be tolerated.

In some embodiments the kit may comprise two or more different types of tiles, for example it may comprise a first set of tiles having a first set of dimensions and a second set of tiles having a second set of dimensions. Such a kit would enable different patterns to be created in the finish. Some patterns, for example Flemish bond includes bricks of differing dimensions.

The or each protrusion enables the tile to be fastened to the wall. However the protrusions additionally enable the tiles to be consistently spaced from one another.

In preferred embodiments the or each protrusion is substantially rectangular in shape (i.e. when viewed from above).

Thus the outer edge of the protrusion is preferably substantially parallel to the edge of the tile from which it extends.

This outer edge of the protrusion may engage with the edge of an adjacent tile and therefore the protrusion enables the tile and the adjacent tile to be placed together with a desired spacing between them. It will be appreciated that the length the protrusion extends from the tile determines the minimum spacing from an adjacent tile. It will also be appreciated that this length can be varied in the manufacture of the tile according to the desired minimum spacing of the tile. In this way a plurality of tiles may be aligned in a dimension perpendicular to the longest edge of the tiles.

In a rectangular shaped protrusion, an edge of the protrusion which is substantially perpendicular to the edge of the tile from which it extends may engage with a similar edge of a protrusion of an adjacent tile. This engagement of edges may enable the tile and the adjacent tile to be aligned in a direction parallel to the longest edge of the tiles. It will be appreciated that the protrusion may function in this way to enable a plurality of brick tiles to be positioned together in a regular pattern and with a consistent, defined spacing between the tiles in two dimensions. Such a pattern is commonly formed in conventional brickwork. However when using brick tiles of the present invention a labourer skilled in the construction of conventional brickwork does not need to be employed.

The kit of the present invention may comprise a plurality of tiles. In such embodiments it may comprise a single fixing element or it may comprise a plurality of fixing elements.

The or each fixing element is arranged to be fastened to the wall and to accommodate the protrusion so as to secure the tile in position. Suitably the fixing element is attached to the wall at one or more points. A protrusion may be accommodated between the wall and the fixing element. In this way the protrusion and therefore the tile is held against the wall.

Preferably the fixing element is an elongate strip.

In some embodiments the fixing element may comprise a single strip that is fastened across a plurality of protrusions of different tiles aligned in a row. Such a strip could be fixed to the wall at one or more points, for example at one point, at two end points or at multiple points along the strip.

In some embodiments the fixing element may comprise an elongate strip and a tab extending substantially perpendicular to the elongate strip. The tab may be shaped to contact the wall between shorter edges of adjacent tiles. The fixing element may be secured to the wall through the tab. Preferably the fixing element comprises more than one tab. The fixing element may comprise a tab extending substantially perpendicular to the elongate strip of the fixing element in one direction and a tab extending substantially perpendicular to the elongate strip of the fixing element in the opposite direction. A fixing element comprising an elongate strip and a tab may be particularly suitable for use with tiles having one protrusion extending from each of the two parallel longer edges.

In some embodiments the kit may comprise a plurality of shorter fixing element strips each of which is fastened across one or more protrusions. Suitably the kit comprises sufficient fixing element(s) to accommodate in use at least one protrusion on each tile.

The fixing element may be made from strips of metal, plastic or another suitably rigid and long lasting material. In some embodiments the fixing element may be shaped to provide an improved fit, for example it may include recessed portions for securing to the wall and raised portions which cover the protrusions. The fixing element may be secured to the wall by any suitable means, for example nails, screws, rivets, bolts and pins. The selection of such means will depend on the base material to which the tiles are fitted. A suitable selection can be made by the person skilled in the art.

The tiles may first be secured onto the wall using an adhesive.

According to a second aspect of the present invention there is provided a method of covering a wall, the method comprising the steps of:

(a) selecting a plurality of tiles each having a protrusion extending from an edge thereof;
(b) arranging said tiles in a regular pattern using the protrusions to determine spacings;
(c) placing one or more fixing elements over the protrusions; and
(d) fastening the fixing element(s) to the wall.

According to a third aspect of the invention there is provided a brick tile having two longer substantially parallel edges, two shorter substantially parallel edges and a thickness; wherein two protrusions extend from each longer edge of the tile; and wherein the dimensions of the protrusions are selected to facilitate alignment of the tiles in a direction perpendicular to the longer edge and in a direction parallel to the longer edge.

According to a fourth aspect of the present invention there is provided a brick tile having two longer substantially parallel edges, two shorter substantially parallel edges and a thickness; wherein a protrusion extends from each longer edge of the tile; and wherein the dimensions of the protrusions are selected to facilitate alignment of the tiles in a direction perpendicular to the longer edge and in a direction parallel to the longer edge.

According to a fifth aspect of the present invention there is provided a tile having a protrusion which extends from an edge thereof.

Preferred features of the second, third, fourth and fifth aspects are as defined in relation to the first aspect.

It will be appreciated that while the invention is useful for providing a brick finish on buildings to which external insulation has been applied, it may also be useful in other applications where a brick finish is necessary, for example in building constructing or to provide an aesthetically pleasing interior finish. The invention facilitates easy alignment of the tiles thus reducing the need for skilled labour.

BRIEF DESCRIPTION OF THE DRAWINGS

The invention will now be further described with reference to the accompanying drawings in which.

DETAILED DESCRIPTION OF EMBODIMENTS OF THE INVENTION

Figure 1:
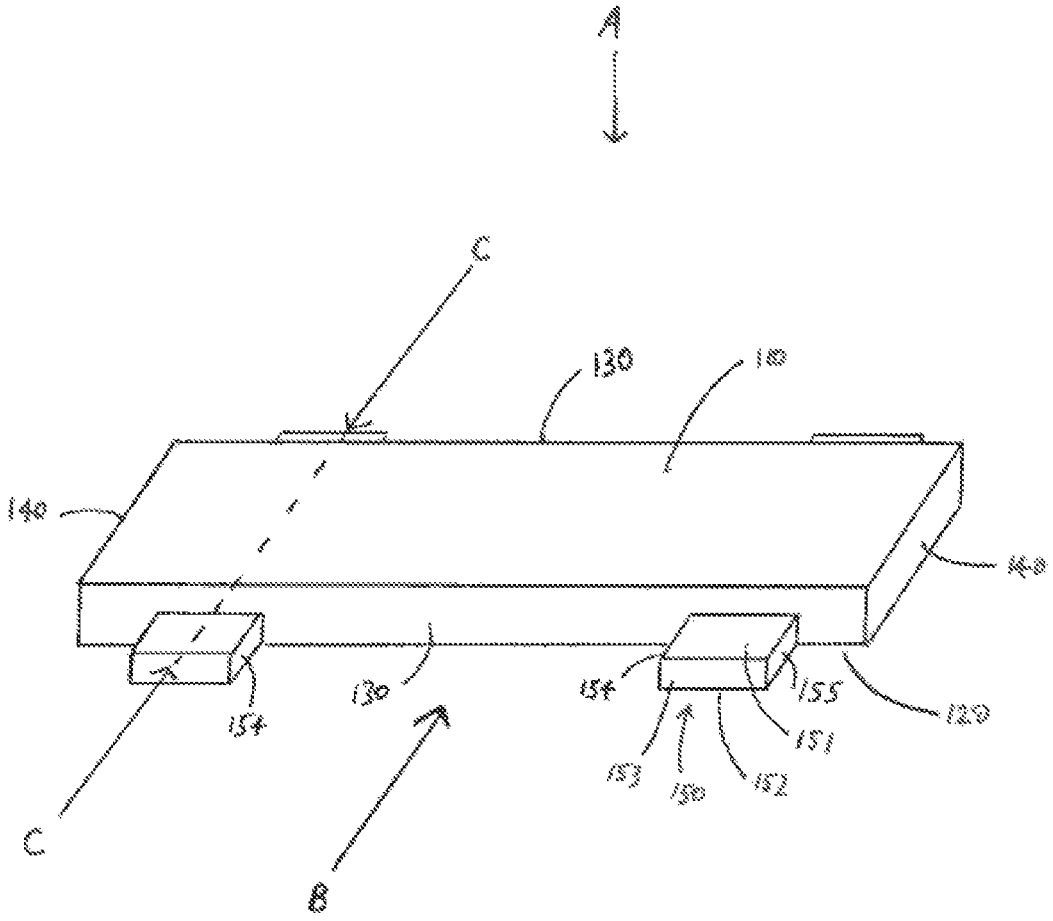
FIG. 1 shows a preferred embodiment of a tile of the invention having four protrusions.
Figure 2A:
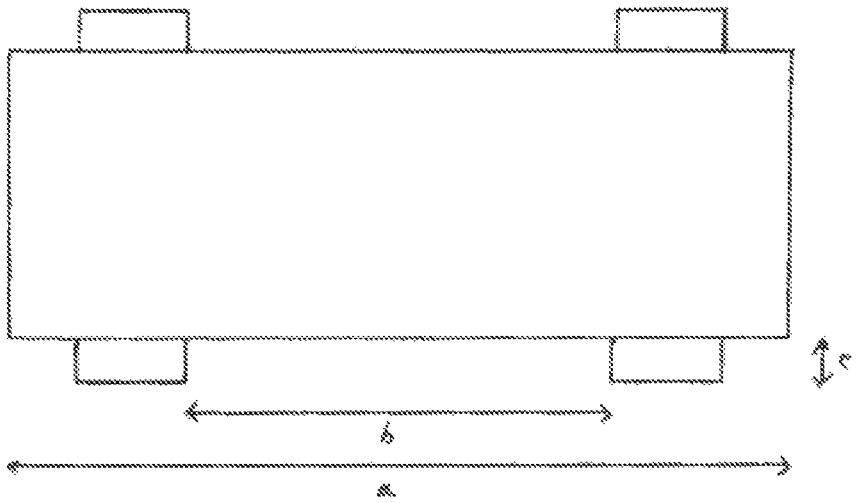
FIG. 2A shows a plan view of the tile of FIG. 1 (view A).
Figure 2B:
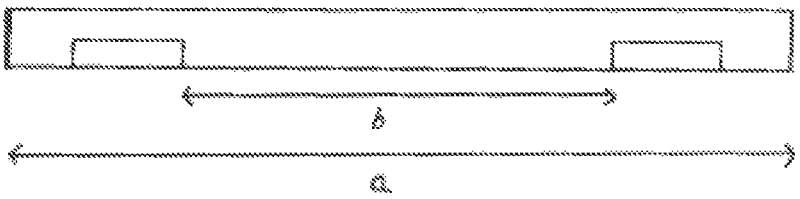
FIG. 2B shows a side view of a longest edge of the tile of FIG. 1 (view B).
Figure 2C:
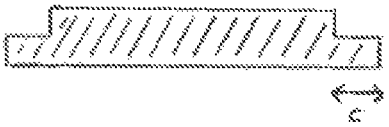
FIG. 2C shows a cross-section of the tile of FIG. 1 along axis C.

The tile shown in FIGS. 1 and 2 comprises an upper face (110), a lower face (120), two longer edges (130), two shorter edges (140) and four protrusions (150). Each protrusion comprises an upper face (151), a lower face (152), an edge (153) substantially parallel to the edge of the tile from which it extends, and two edges (154 and 155) substantially perpendicular to the edge of the tile from which the protrusion extends.

The dimensions and spacing of the protrusions are suitably selected to allow easy alignment of the tiles, for example in a stretcher bond pattern, with a consistent spacing between adjacent tiles. With reference to the dimensions indicated in FIGS. 2A, 2B and 2C, one suitable ratio of dimensions may be calculated using the formula:

$$b=((a+c)/2)\pm(c/2)$$

wherein a is the length of the longest edge inside of the tile, b is the distance between the edges of the protrusions intended to engage with similar edges on adjacent tiles and c is the distance which the protrusion extends from the edge of the tile. ±(c/2) represents the tolerance of variation in the length b. In the embodiments which comprise a single protrusion extending from two parallel edges of the tile and in which the protrusions are of equal size, length b is equal to the length of the protrusions.

Figure 3:
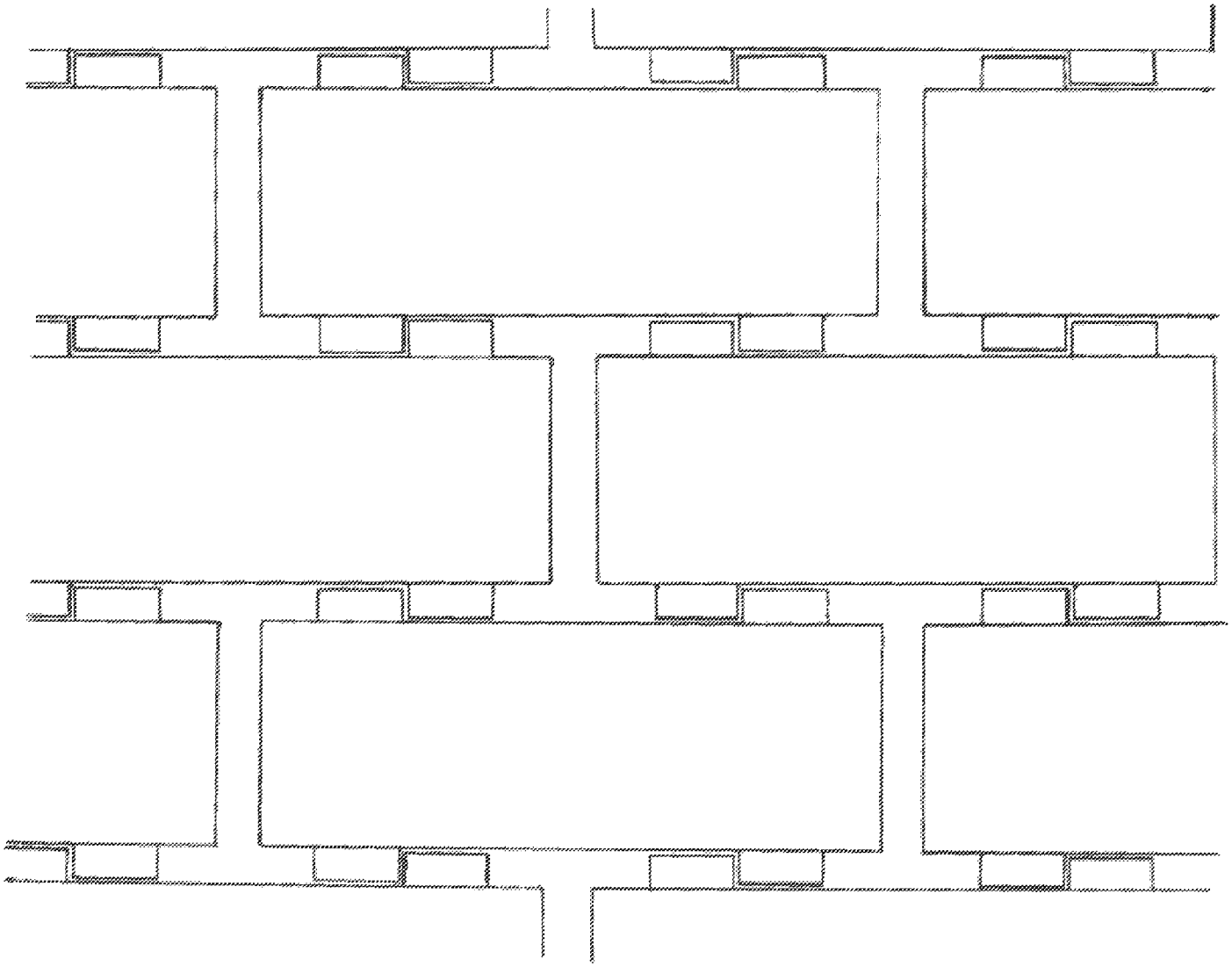
FIG. 3 shows a plan view of a plurality of tiles arranged on a wall in a stretcher bond-type pattern.
Figure 4:
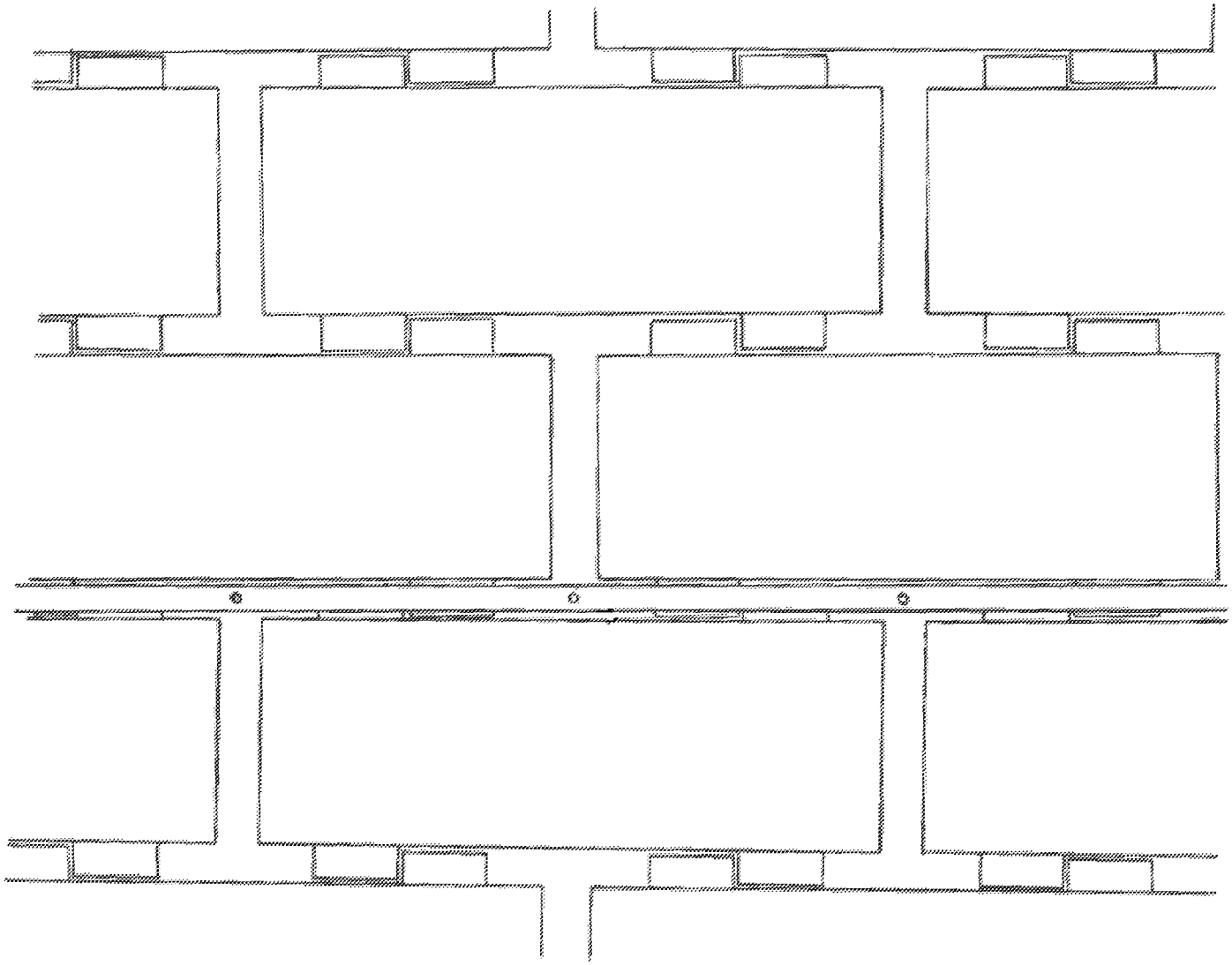
FIG. 4 shows a plan view of a plurality of tiles arranged on a wall in a stretcher bond-type pattern and secured using a single strip fixing element.
Figure 5:
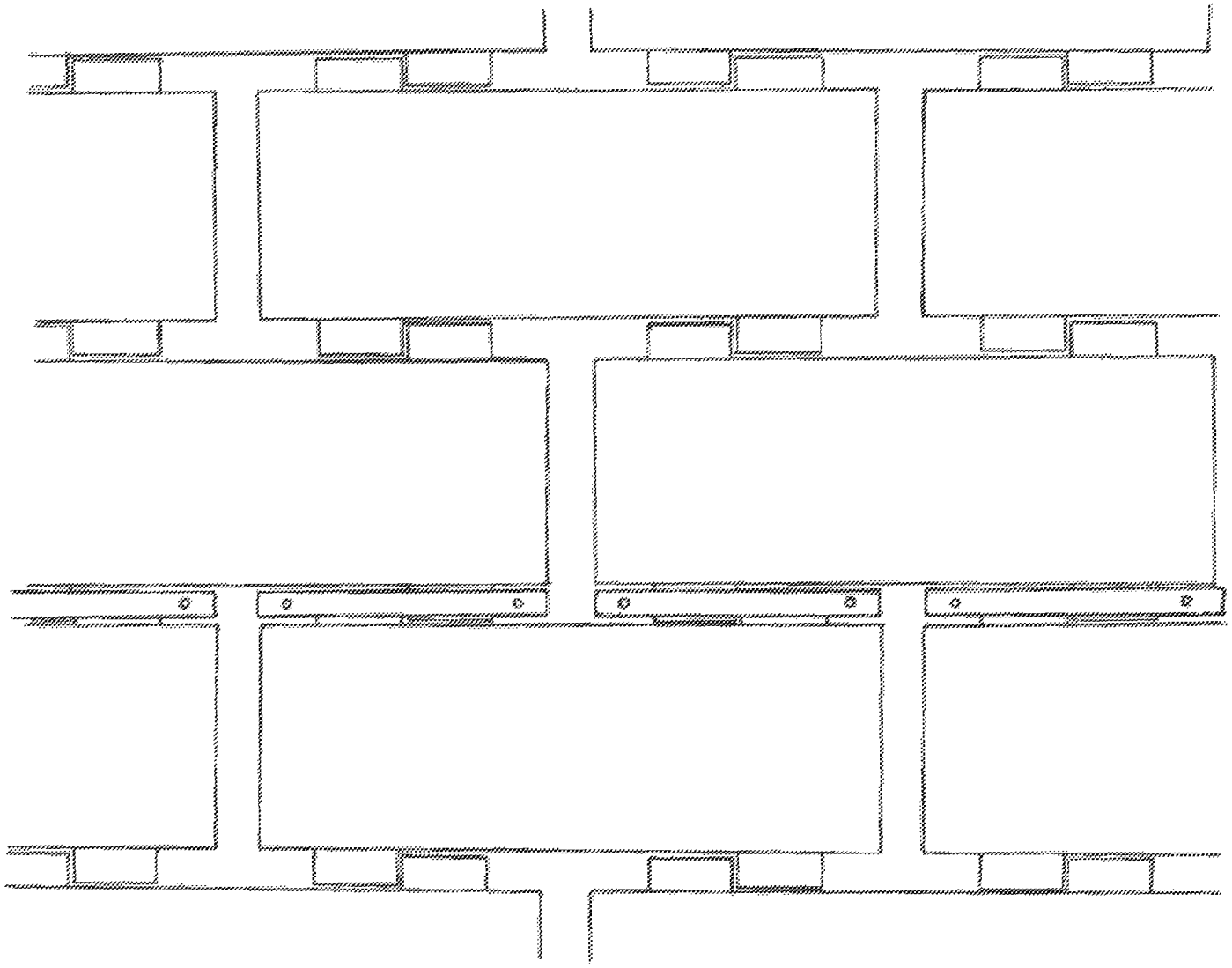
FIG. 5 shows a plan view of a plurality of tiles arranged on a wall in a stretcher bond-type pattern and comprising a plurality of fixing elements.
Figure 6:
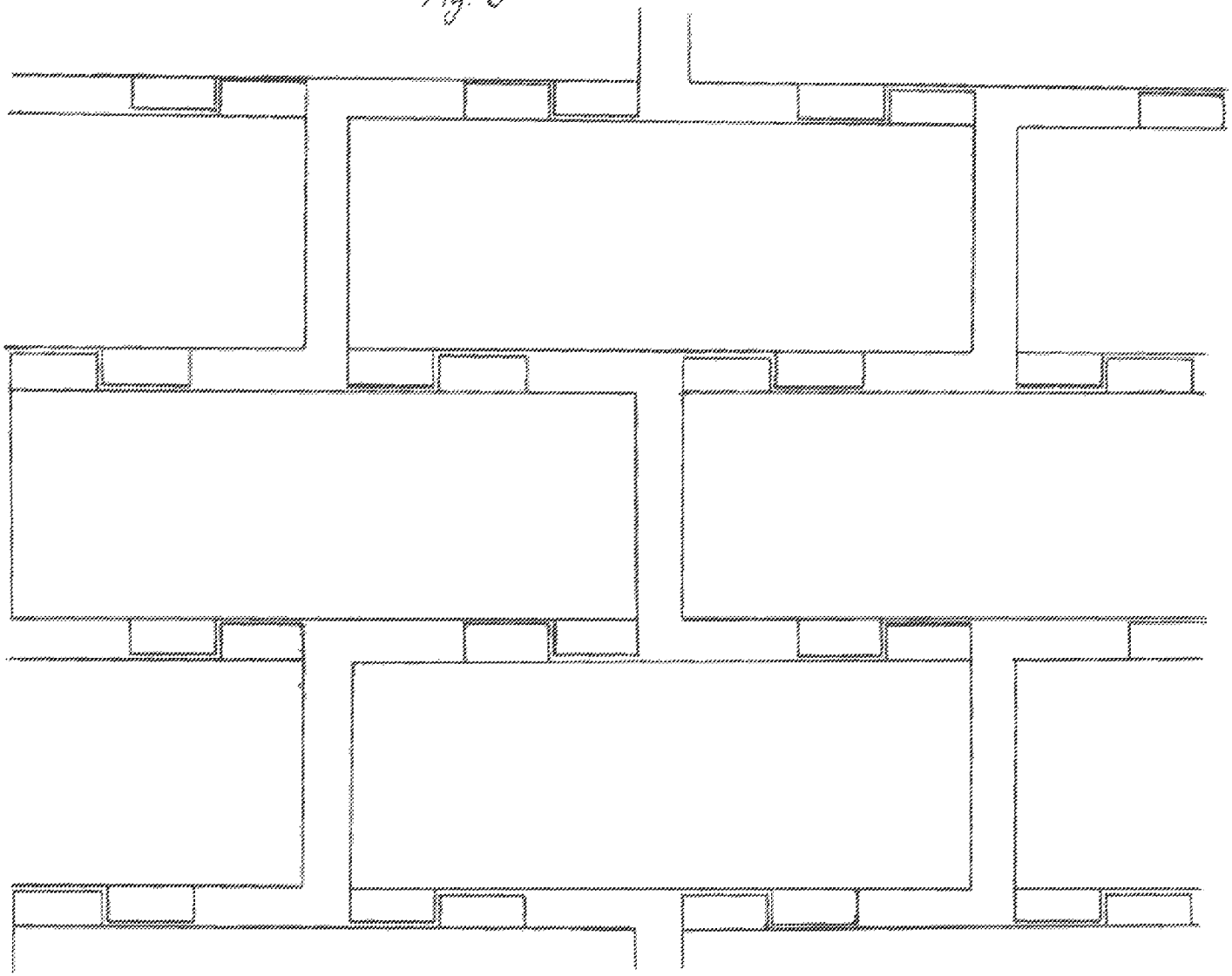
FIG. 6 shows an alternative tile design in which the protrusions are not symmetrically aligned along the edge of the tile.
Figure 7:
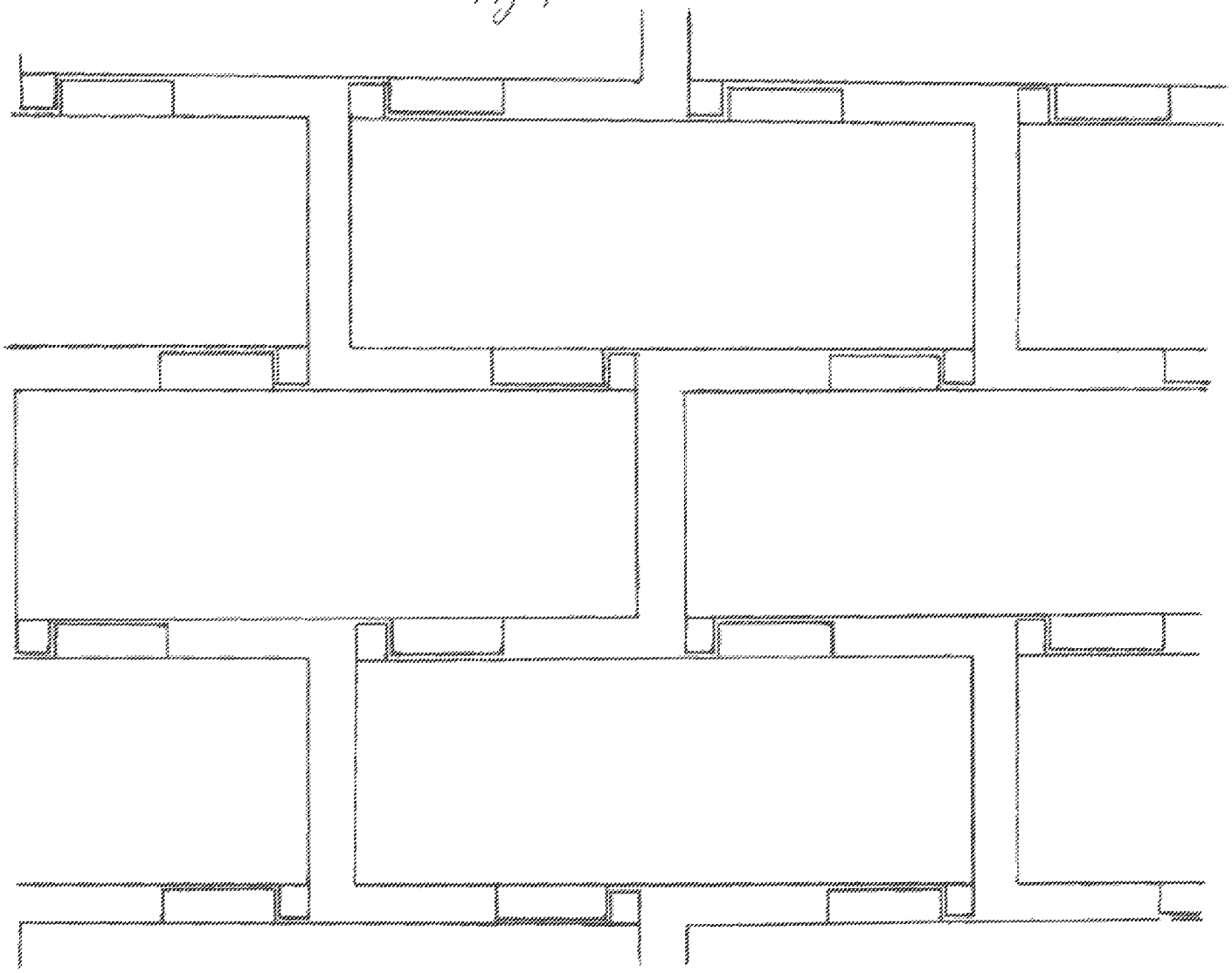
FIG. 7 shows a further alternative in which two different sizes of protrusions are included.

Selection of such a ratio enables easy alignment of the tiles as indicated in FIG. 3. These may be initially glued into position and then secured by one or more fixing element strips (see FIGS. 4 and 5).

Alternative tiles are shown in FIGS. 6, 7 and 9 to 15. The dimensions of these alternative tiles are within the formula given.

Figure 8:
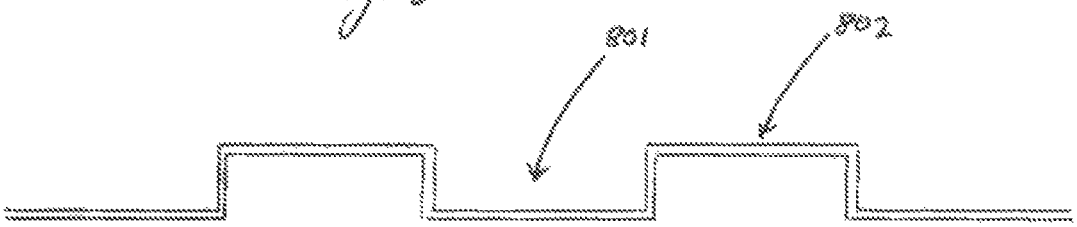
FIG. 8 shows a side view of a fixing element strip according to the invention.
Figure 9:
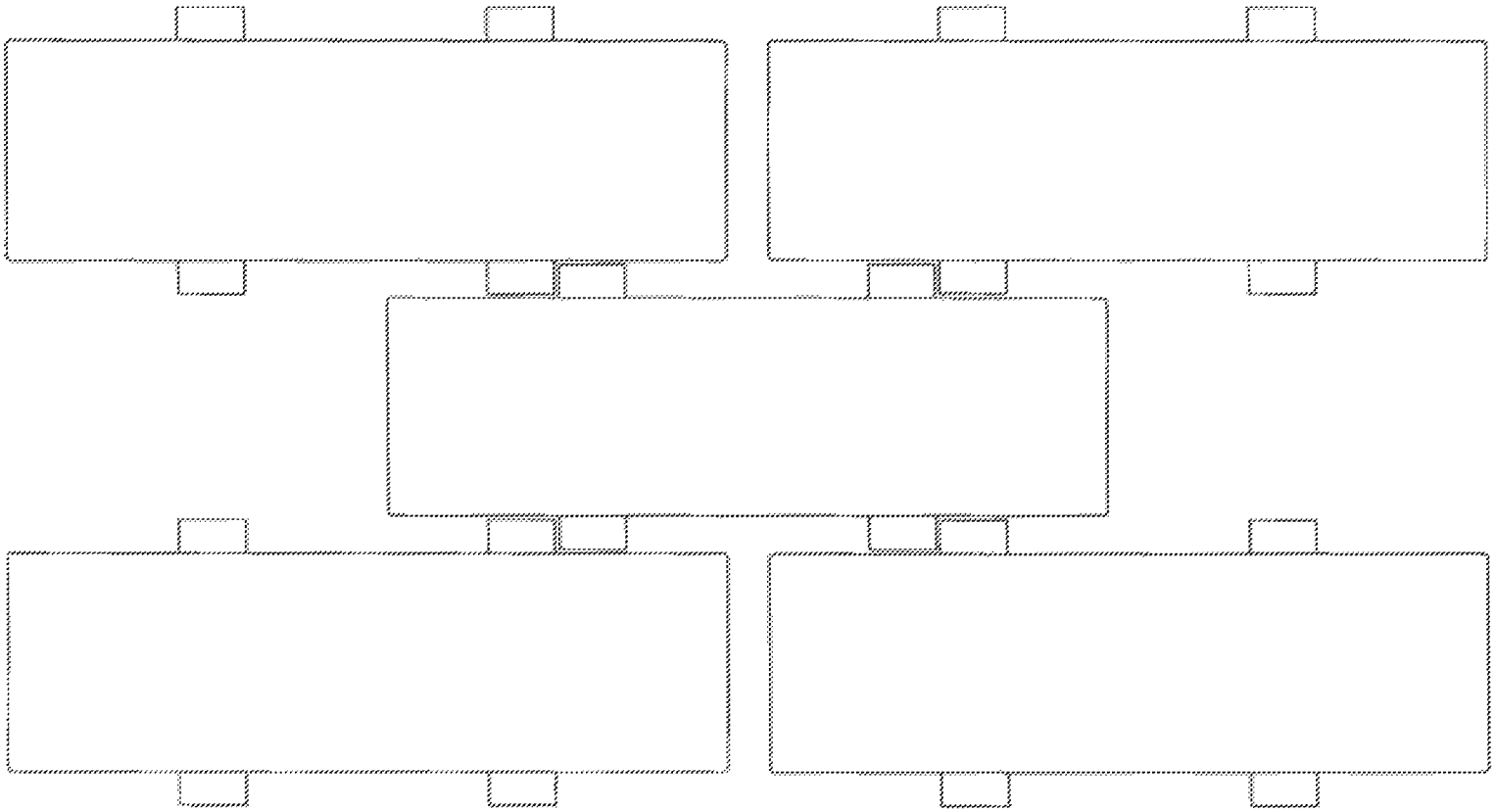
FIG. 9 shows an alternative tile design in which the protrusions are symmetrically aligned along the edge of the tile.
Figure 10:
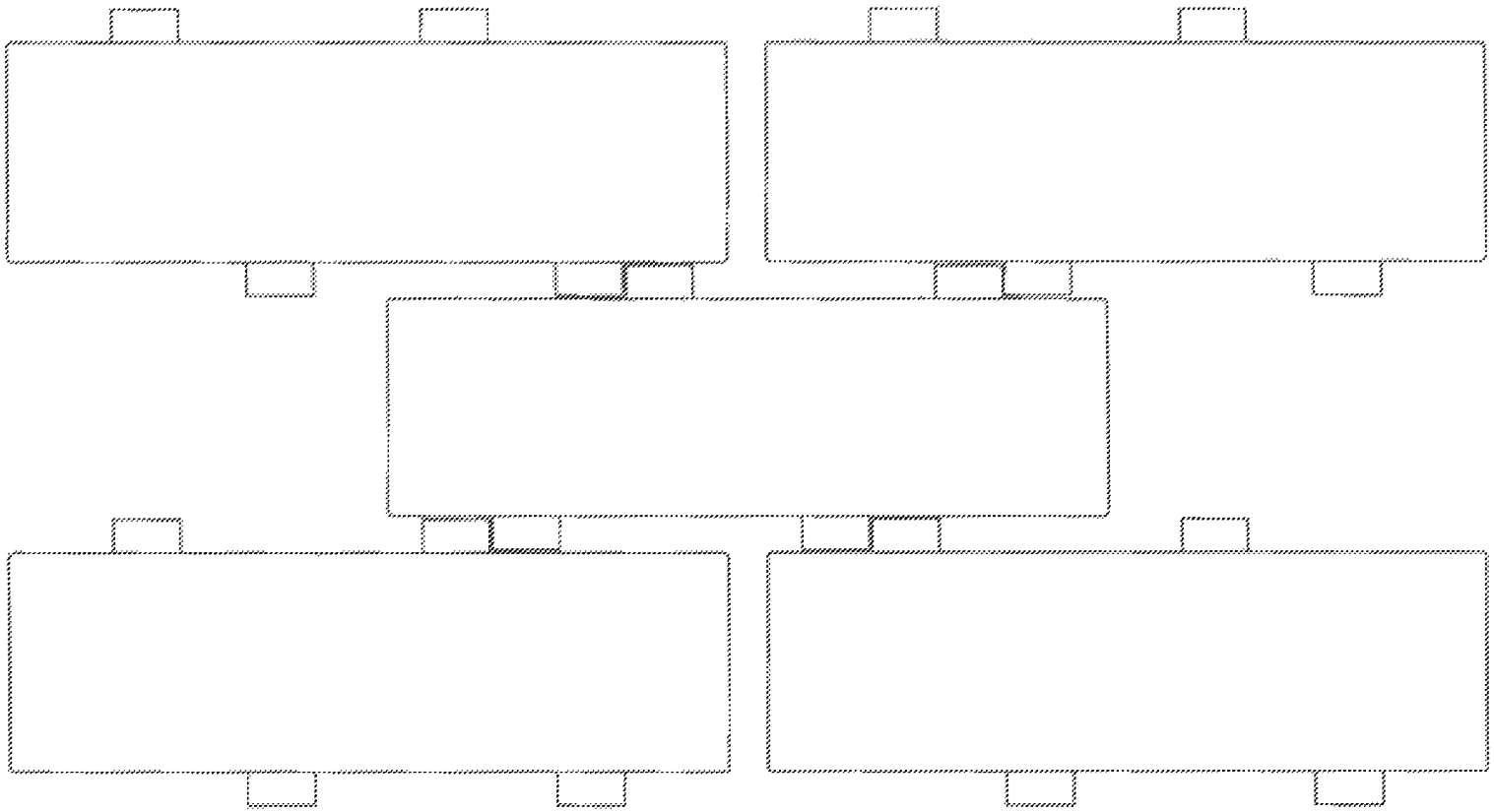
FIGS. 10, 11 and 12 show alternative tile designs in which the protrusions are not symmetrically aligned along the edges of the tile.
Figure 11:
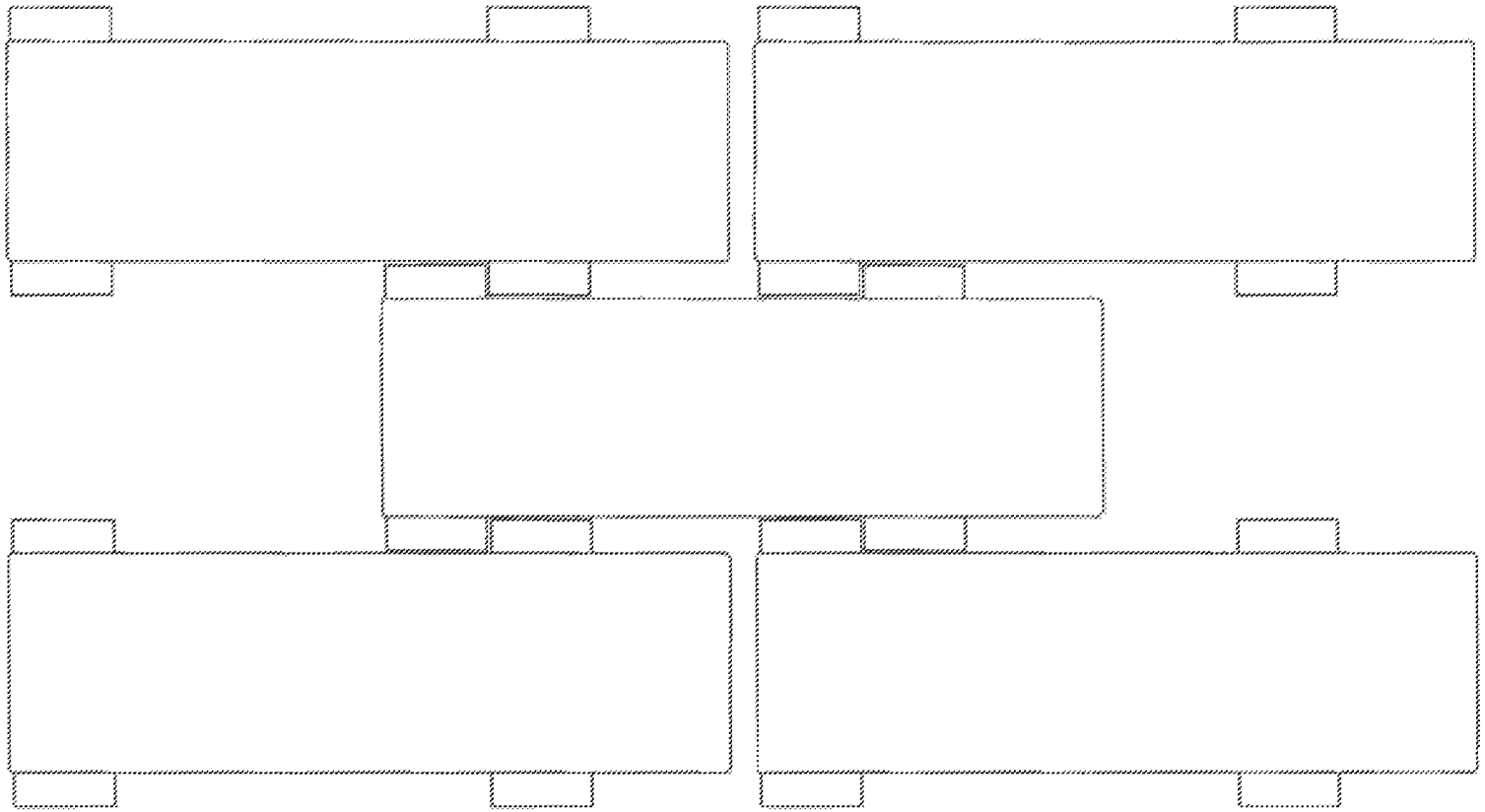
Figure 12:
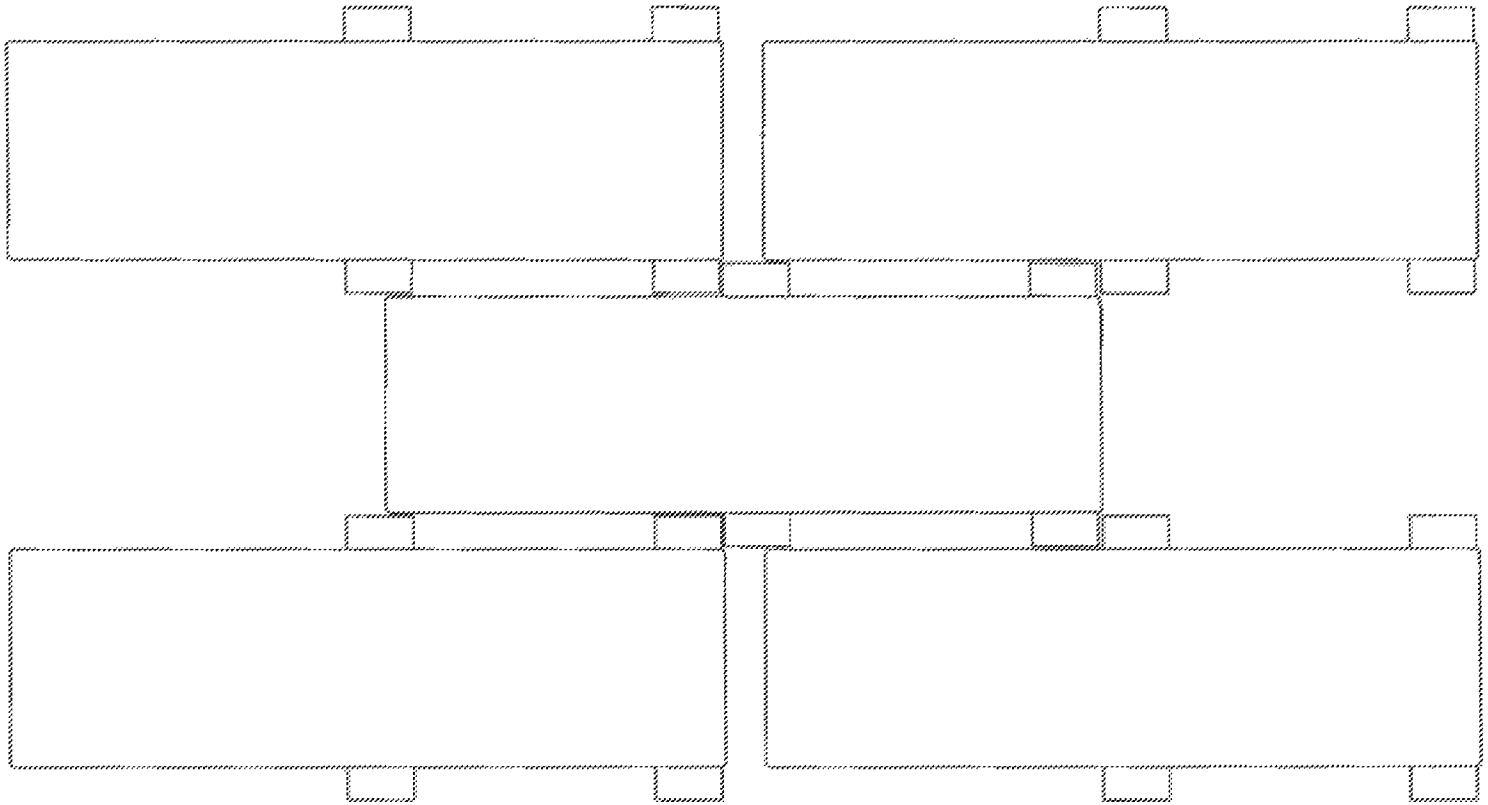
Figure 13:
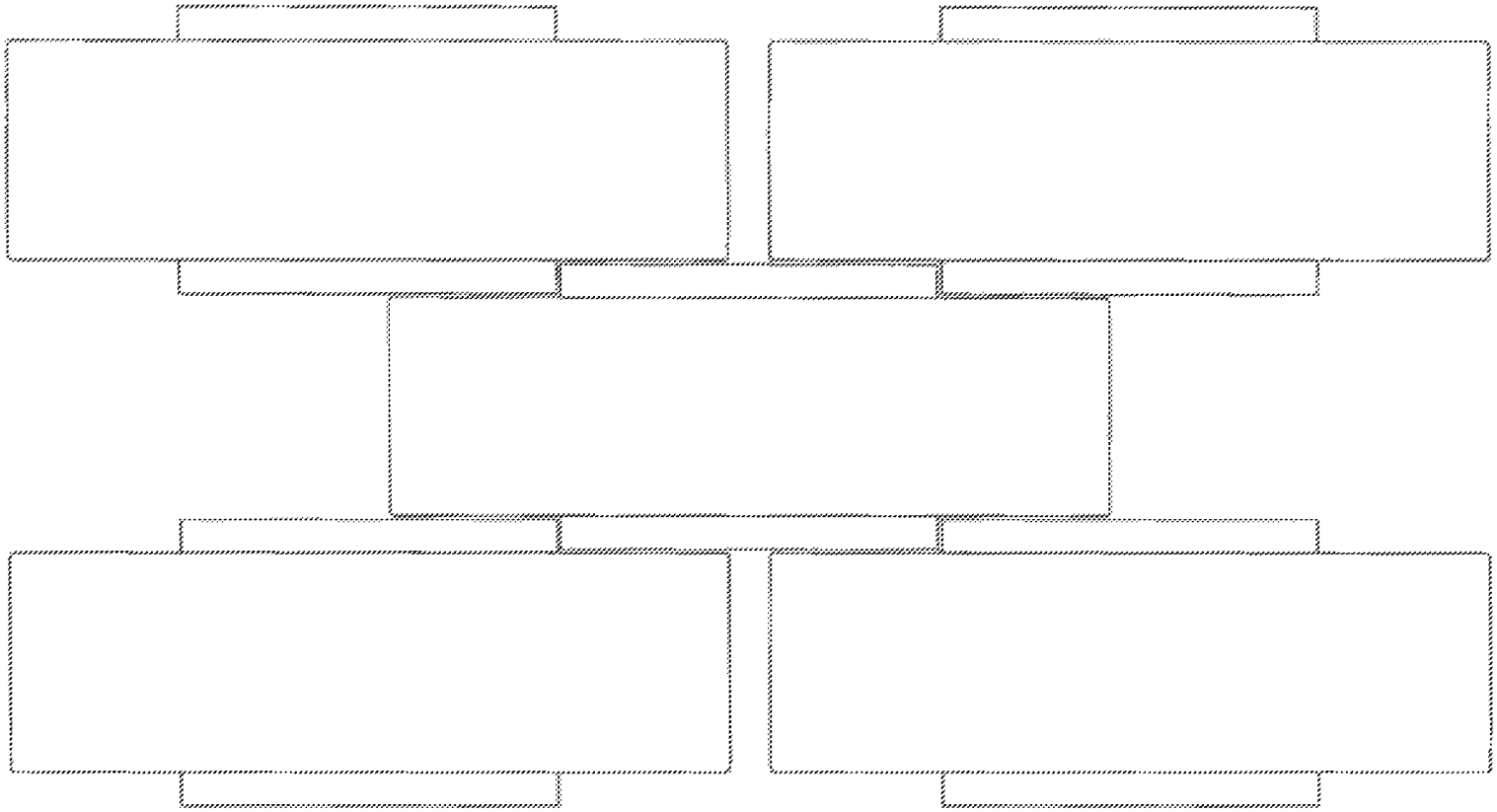
FIG. 13 shows an alternative tile design in which one protrusion extends from each of the two parallel longer edges of the tile. The protrusions are of equal size and each is arranged at the centre of the edge of the tile from which the protrusion extends, providing a symmetrical tile.
Figure 14:
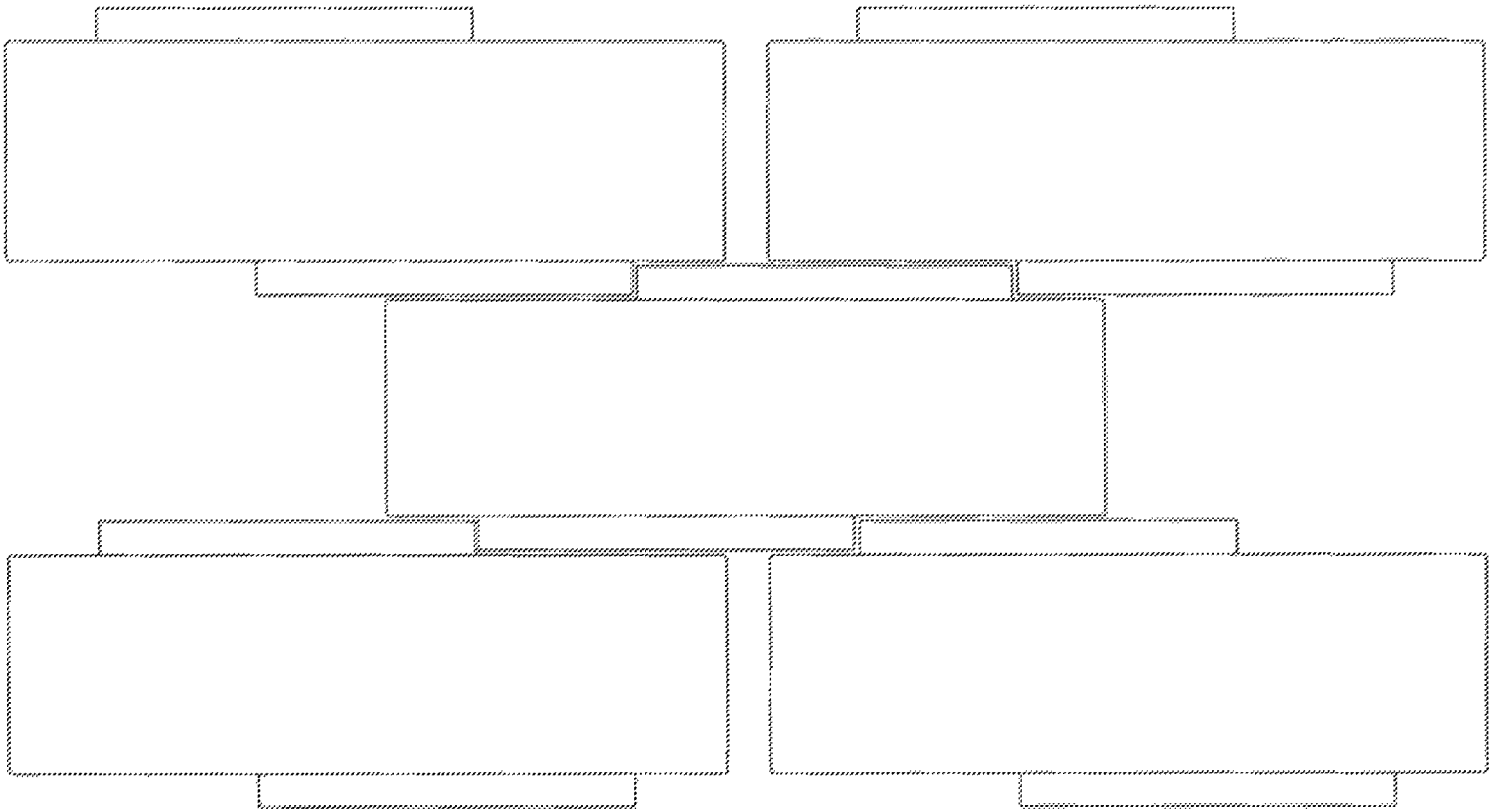
FIG. 14 shows an alternative tile design in which one protrusion extends from each of the two parallel longer edges of the tile. The protrusions are of equal size and they are off-set with respect to the centre of the edge from which the protrusion extends in opposite directions along their respective edges, providing an asymmetrical tile.
Figure 15:
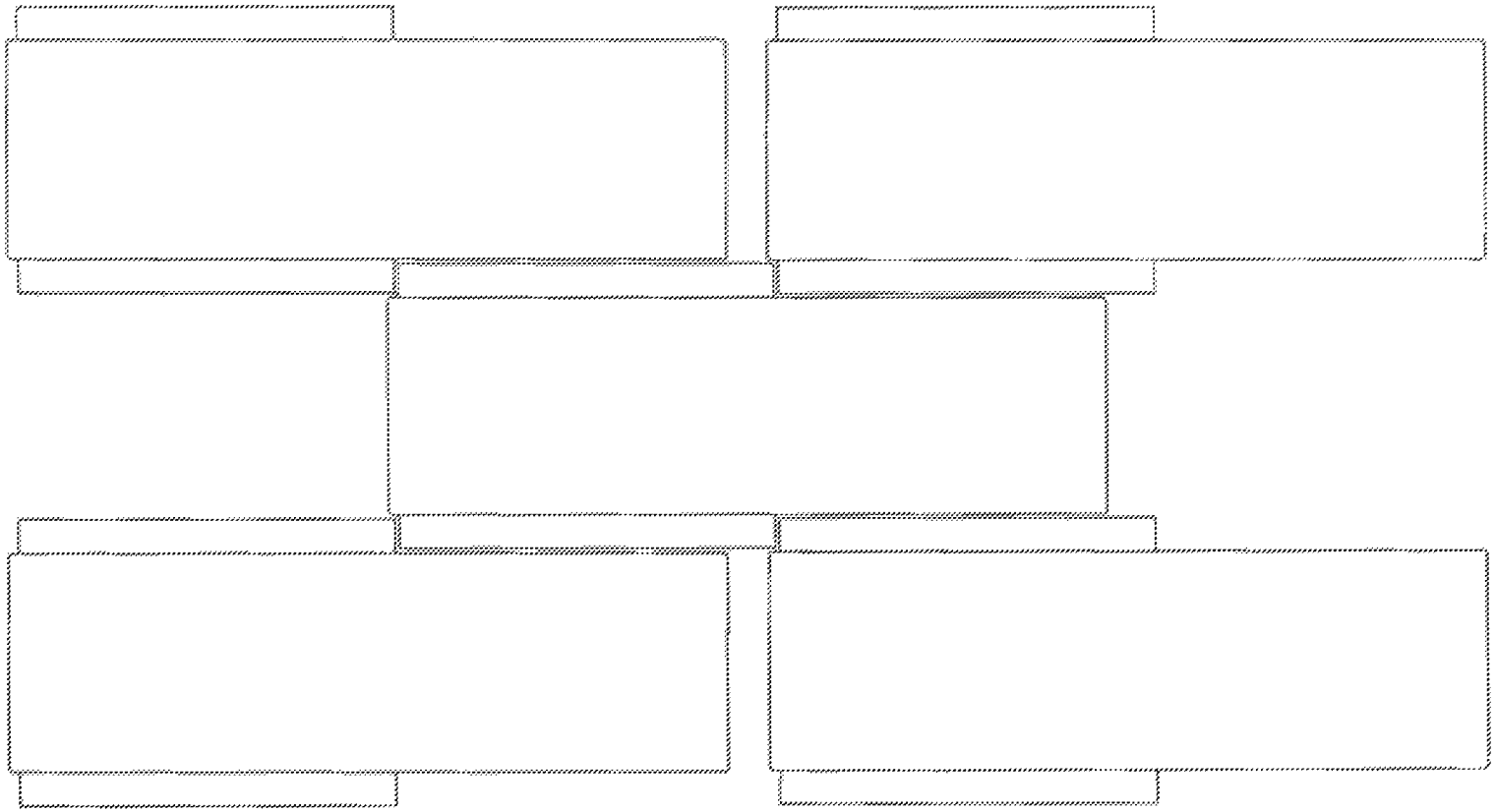
FIG. 15 shows an alternative tile design in which one protrusion extends from each of the two parallel longer edges of the tile. The protrusions are of equal size and they are off-set with respect to the centre of the edge from which the protrusion extends in the same direction along their respective edges, providing an asymmetrical tile.

FIG. 8 shows a fixing element strip including recessed portions 801 at which the strip may be fixed to the wall and raised portions 802 which cover the protrusions.

The invention claimed is:

1. A kit for fixing tiles to a wall comprising: a tile having a protrusion extending from an edge thereof; and a fixing element arranged to be fastened to the wall and to accommodate the protrusion so as to secure the tile in position, wherein the fixing element is an elongate strip having at least one fastening device for fastening the tile and fixing element to the wall, and at least one receiving device having a projection extending away from the one fastening device providing a recess in the fixing element for receiving the protrusion therein, the at least one fastening device being selected from a group consisting of: an aperture, a hook, and a loop; and the protrusion is shorter in length than the edge of the tile from which the protrusion extends, wherein the protrusion of the tile is engaged by the recess of the fixing element and held against the wall via the one fastening device when the fixing element affixes the tile to the wall.

2. A kit according to claim 1 wherein the tile is a brick tile.

3. A kit according to claim 1 wherein the tile has two sets of parallel sides.

4. A kit according to claim 1 wherein the thickness of the protrusion is less than the thickness of the tile.

5. A kit according to claim 1 wherein the tile includes more than one protrusion.

6. A kit according to claim 5 wherein the tile includes a first protrusion extending from a first edge and a second protrusion extending from a second edge parallel to the first edge.

7. A kit according to claim 5 wherein the tile includes two protrusions extending from a first edge and two protrusions extending from a second edge.

8. A kit according to claim 6 wherein the dimensions and spacing of the protrusions are selected to allow alignment of the tile with other tiles in two dimensions.

9. A kit according to claim 8 wherein the dimensions of the tile fall within the formula:

$$b=((a+c)/2)\pm(c/2)$$

wherein a is a length of a longest edge inside the tile, b is a distance between the edges of the protrusions intended to engage with similar edges on adjacent tiles, c is a distance which the protrusion extends from the edge of the tile, and ±(c/2) is a tolerance of variation in distance b.

10. A kit according to claim 1 which comprises a plurality of the tiles.

11. A kit according to claim 10 wherein the tiles each include a first tile and second tile:

a first protrusion extending from a first edge of the first tile and a second protrusion extending from a second edge of the second tile parallel to the first edge of the first tile, wherein a first outer edge of the first protrusion is substantially parallel to the first edge of the first tile and is adapted to engage with the second edge of the second tile; and wherein a second outer edge of the first protrusion is substantially perpendicular to the first edge, and is adapted to engage with an edge of the second protrusion of the second tile, enabling the plurality of tiles to be positioned together in a regular pattern and with a consistent, defining spacing between the first and second tiles in two dimensions.

12. A method of covering a wall, the method comprising the steps of:

a. (a) selecting a plurality of tiles each having a protrusion extending from an edge thereof;

b. (b) arranging said tiles in a regular pattern using the protrusions to determine spacings;

c. (c) providing one or more fixing elements; and d. (d) fastening each fixing element to the wall, e. wherein each fixing element comprises an elongate strip having at least one fastening device for fastening the fixing element and tile to the wall, and at least one receiving device having a projection extending away from the one fastening device providing a recess in the fixing element for receiving the protrusion therein, the at least one fastening device being selected from a group consisting of: an aperture, a hook, and a loop, and the protrusion is shorter in length than the edge of the tile from which the protrusion extends, the fastening of each fixing element to the wall comprises placing the projection of each fixing element over at least one of the protrusions engaging the protrusion within the recess and fastening the fastening device to the wall with the protrusion received in the recess.

13. A plurality of adjacent brick tiles, each tile having two longer substantially parallel edges, two shorter substantially parallel edges and a top surface and a bottom surface with a thickness therebetween; wherein a protrusion extends from each longer edge of each of the plurality of tiles, each protrusion having a top surface and a bottom surface with a thickness therebetween, the protrusion being shorter in length than each longer edge of the tile; and wherein the dimensions of the protrusions are selected to facilitate alignment of the tiles in a direction perpendicular to the longer edge and in a direction parallel to the longer edge, wherein each protrusion comprises a first outer edge substantially parallel to the edge of the tile from which the protrusion extends and is adapted to engage with one of the edges of one of the adjacent tiles, and second outer edges substantially perpendicular to the edge of the tile from which the protrusion extends, one of the second outer edges of each protrusion is adapted to engage with one of the second edges of one of the protrusions of one of the adjacent tiles, enabling the plurality of tiles to be positioned together in a regular pattern and with a consistent, defined spacing between the tiles in two dimensions, wherein the first outer edges of the protrusions engage with the edges of the adjacent tiles and the second outer edges of the protrusions engage with the second outer edges of the protrusions of the adjacent tiles when the tiles are aligned.

14. A brick tile according to claim 13, wherein two protrusions extend from each longer edge of the tile.

* * * * *